United States Patent [19]

Noguchi et al.

[11] 3,962,985

[45] June 15, 1976

[54] TWIN-SHAFT TYPE PROPULSION ARRANGEMENT FOR A TUG BOAT

[75] Inventors: Tadamasa Noguchi, Kawasaki; Senzou Ehata, Tokyo; Masao Matsuura, Ageo, all of Japan

[73] Assignee: Niigata Engineering Co., Ltd., Tokyo, Japan

[22] Filed: Jan. 20, 1975

[21] Appl. No.: 542,629

[52] U.S. Cl. ..... 115/34 R; 115/37

[51] Int. Cl.[2] ..... B63H 5/06

[58] Field of Search ..... 115/34 R, 35, 37; 192/85 R, 85 AA, 109 F

[56] References Cited

UNITED STATES PATENTS

| | | | |
|---|---|---|---|
| 2,166,586 | 7/1939 | Gates | 192/85 AA |
| 3,112,728 | 12/1963 | Krause | 115/37 |
| 3,199,646 | 8/1965 | McBride | 192/85 AA |
| 3,217,851 | 11/1965 | Mogk et al. | 192/85 AA |
| 3,371,759 | 3/1968 | Sapolsky | 192/85 R |

*Primary Examiner*—Duane A. Reger
*Assistant Examiner*—Stuart M. Goldstein
*Attorney, Agent, or Firm*—Sughrue, Rothwell, Mion, Zinn & Macpeak

[57] ABSTRACT

A twin-shaft Z type propelling arrangement for a tug boat comprises a variable slip transmission, such as a friction clutch provided between the main engine and the Z type propelling mechanism of the boat, and a mechanism for providing variable amount of slip for the transmission mechanism at the minimum speed operation of the engine.

6 Claims, 7 Drawing Figures

FIG. 1
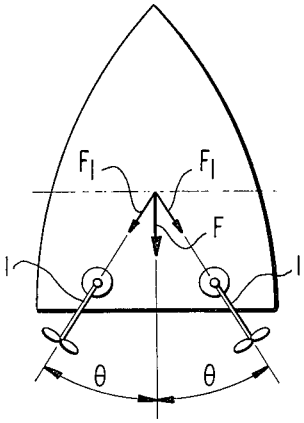
FIG. 2
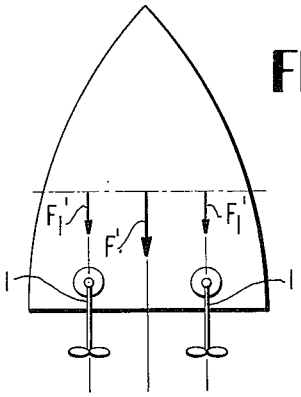
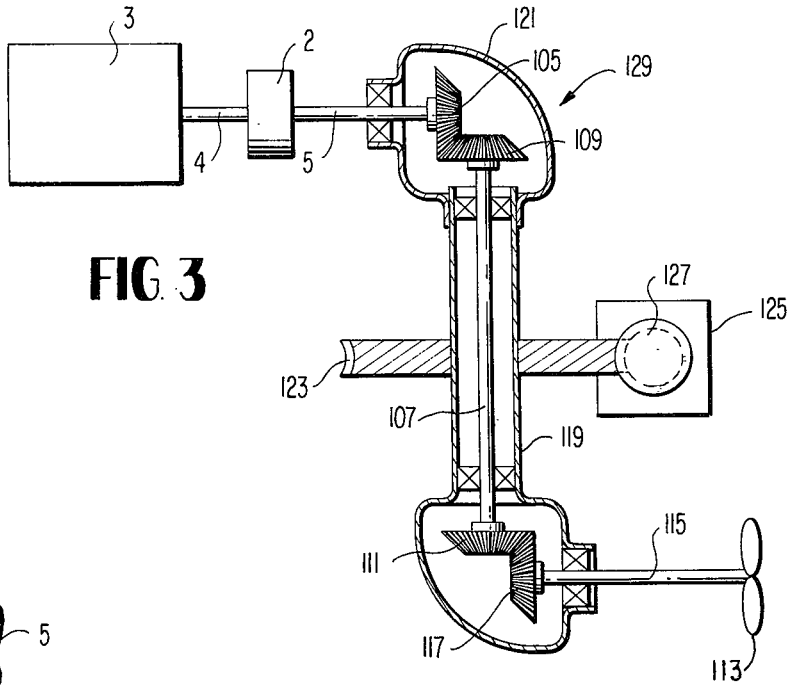
FIG. 3
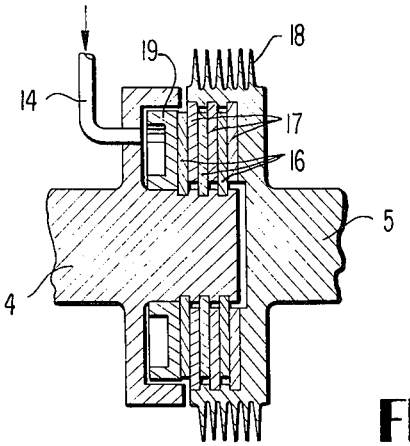
FIG. 5

FIG. 4
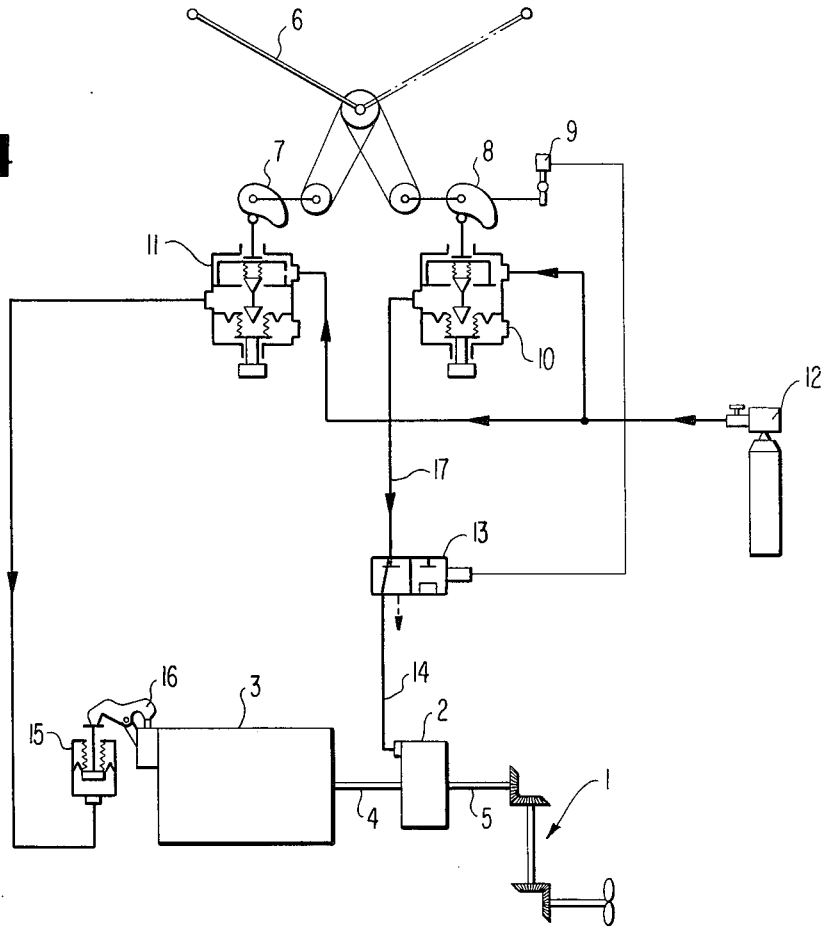
FIG. 6
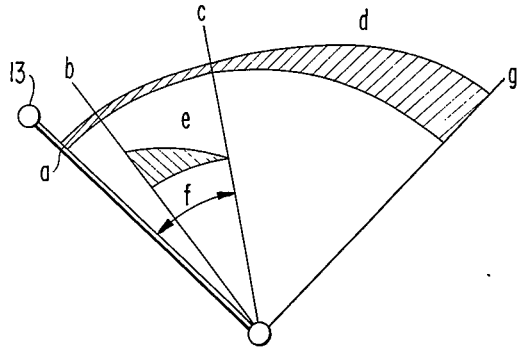
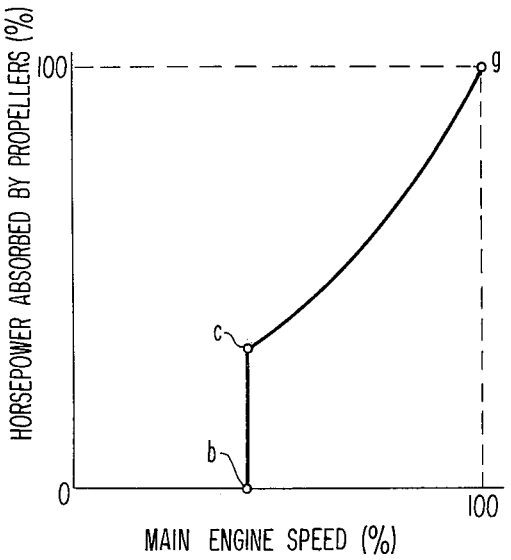
FIG. 7

TWIN-SHAFT TYPE PROPULSION ARRANGEMENT FOR A TUG BOAT

BACKGROUND OF THE INVENTION

1. Field of the Invention

The present invention relates to a twin shaft Z type propelling means for tug boats, and more particularly to such propelling means which can provide propeller revolution speed slower than the speed normally obtained at minumum revolution speed of the main engine, through slipping of clutch means, thereby improving the maneuverability of the tug boat.

2. Description of the Prior Art

As is well known to these skilled in the art, tug boats must perform various specific functions such as standing, performing front, lateral or slant movements, and going dead-slow, ahead or astern, all while working in limited port areas.

Those functions have been performed, in conventional tug boats having so called Z type propelling means with twin shafts, by controlling the direction of thrust of the two shafts. Namely, for the dead-slow going, the propellers must be so orientated as to diverge as shown in FIG. 1 so as to relieve part of their thrust outwardly, since the dead-slow going is hard to effect with the direction of thrust coinciding with the longitudinal direction of the hull.

Referring to FIG. 1, reference numeral 1 designates Z type propelling means consisting of two propellers, each of which is adapted to generate thrust as represented by vectors $F_1$. The resultant thrust of those two conponents $F_1$ is represented by a vector F. Thus, where the angle $\theta$ at which the shafts are inclined with respect to the longitudinal axis of the hull, the resultant vector F is given by the following equation.

$$F = 2F_1 \cos \theta$$

It will be understood, when the tug boat must be maneuvered at a speed lower than as could be obtained by vectors $F_1$ which correspond to the minimum speed of the main engine, the angle $\theta$ is adjusted to provide fine adjustment of the resultant thrust F.

This way of controlling the thrust is, however, inconvenient in that the violent flow of water orientated laterally of the tug boat sweeps away small boats thereabout, or makes those boats crash into each other or cut fishery nets.

SUMMARY OF THE INVENTION

It is therefore an object of the invention to provide an improved twin shaft Z type propelling means for tug boats in which dead-slow going is performed without changing the orientation of the propellers.

Namely, in the twin shafts Z type propelling means provided by the present invention, the thrust force of each propeller is varied by controlling the amount of slip of a friction clutch provided between the main engine and the propellers, thereby making it possible to obtain dead-slow operation without changing the orientation of the propellers. It is to be noted that, since only the required amount of thrust is generated by the propellers, aforementioned eventual accidents by the water stream which have been inevitable with the conventional propelling means can be fairly avoided.

Another object of the invention is to provide an improved twin shaft Z type propelling means which can be maneuvered, over full speed and dead-slow speed, by handling only one lever.

Further objects and advantageous features of the invention will become clear from the following description taken in conjunction with the attached drawings.

BRIEF DESCRIPTION OF THE DRAWINGS

FIG. 1 is a schematic illustration showing the manner in which conventional twin shaft Z type propelling means are controlled to provide dead-slow operation.

FIG. 2 is a schematic illustration showing the manner in which twin shafts Z type propelling means according to invention are controlled to provide dead-slow operation.

FIG. 3 is a side elevation of the twin shafts Z type propelling means according to the invention.

FIG. 4 is a connection diagram showing the system according to the invention.

FIG. 5 is a cross-sectional view of a friction clutch employed in accordance with the invention.

FIG. 6 is a diagram showing exemplarily, the manner in which the output shaft is controlled.

FIG. 7 is a diagram showing the relationship between the revolution speed of the main engine and the horsepower absorbed by the propellers.

DETAILED DESCRIPTION OF THE INVENTION

Referring to FIG. 3, reference numeral 3 designates an engine, the output of which is transmitted to an output shaft 5 through an input shaft 4 and a clutch 2. The output shaft 5 is provided at its outer end with a bevel gear 105 which engages another bevel gear 109 secured to the top end of a shaft 107. The shaft 107 is provided at is lower end another bevel gear 11 which engages a bevel gear 117 on a shaft 115 supporting a propeller 113, the gear drive generally being designated at 129.

The shaft 107 and the bevel gears 109, 111 are covered by a cover 119, while the bevel gears 105, 109 are covered with another cover 121.

To the middle portion of the cover 119, is secured a worm wheel 123 through the medium of which the propeller 113 can be rotated through 360° about the shaft 107. Worm wheel 123 is rotated by meshed pinion 127 powered by motor drive mechanism 125. The above described arrangement is the so called "Z type propelling means."

Referring now to FIG. 4 which schematically shows a twin shaft Z type propelling means embodying the present invention, numeral 1 designates a Z type propelling means, 2 designates a friction clutch, 3 designates a main engine, 4 designates an input shaft for the clutch 2, 5 designates an output shaft, 6 designates a maneuvering handle, 7,8 designate cams interlocked with the maneuvering handle 6, 9 designates a micro switch for issuing signals for engaging and disengaging the clutch, 10 designates a control valve adapted to control the slip of the clutch 2, 11 designates a speed control valve for the main engine, 12 designates a source adapted to supply air including an air supply valve to the valves 10, 11, 13 designates a clutch actuating valve electrically connected to the micro switch 9 and connected to the slip control valve 10 through an air pipe 17, 14 designates an air conduit adapted to pass air from the slip control valve 10 to the clutch 2 through the actuating valve 13, 15 designates a speed control piston adapted to be operated by air from the speed control valve 11, and 16 designates a governor adapted for regulating the speed of the main engine.

Referring now to FIG. 5 which shows the clutch 2 in detail, the clutch 2 which is of the pneumatic type comprises input and output friction discs 16, 17 which are mounted to respective input and output shafts 4,5. A series of heat-radiating fins 18 are provided for radiating heat generated during the slipping of the discs. Numeral 19 designates a clutch piston which is communicated to the slip control valve 10 through the air conduit 14.

In operation, electrical signals are issued from the microswitch 9, upon operating the maneuvering handle 6, the clutch actuating valve 13 is switched to ON so that the air from slip control valve 10 passes to clutch piston 19 which then pushes the friction discs 16 and 17 together. The arrangement is such that the force of air exerted on the clutch piston 19 is varied as the slip control valve 10 is operated by the handle, thereby the contact pressure between respective discs 16, 17 is varied to provide different amounts of slip.

It will be understood that the revolution speed of the output shaft 5 can be varied with the revolution speed of the input shaft 4 kept constant, thanks to the provision of the slip control valve 10.

This function, which is usually effected when the input shaft is at its minimum speed, constitutes the principal characteristic feature of the present invention. Namely, owing to this feature, it becomes possible to maneuver the boat at dead-slow speed without changing the orientation or direction of the Z type propelling means.

Referring now to FIG. 6 which shows as an example the manner in which the output shaft 5 is controlled by the maneuvering handle 6, *a* shows the position of the handle where the clutch is disengaged, while *b* shows the position where the clutch is just engaged. It will be understood that the position *b* corresponds to the largest slip of the clutch while *c* shows the position where the slip of the clutch is zero.

The revolution speed of the main engine and the amount of the slip of the clutch is designated at *d* and *e*, respectively. The symbol *f* designates an area where the handle provides the minimum speed of the engine, that is, dead-slow speed, while *g* designates the position at which the handle provides the maximum speed of the engine.

FIG. 7 shows the relationship between the revolution speed of the main engine and the horsepower absorbed by the propeller, which horsepower varies according to the possition of the handle 6. The symbols *b*, *c*, and *g* in FIG. 7 correspond respectively to those in FIG. 6.

Thus, in the range between *b* and *c*, the horsepower transmitted to the propeller is varied by changing the slip of the clutch, with the revolution speed of the main engine kept at minimum, while in the region between *c* and *g*, the clutch does not slip and the horsepower absorbed by the propeller is changed by changing the revolution speed of the engine.

It is to be noted that, although a specific embodiment has been described, the scope of the present invention is not limited thereto.

For example, any transmission means capable of providing variable slip, e.g. a hydraulic friction clutch, an electro-magnetic clutch or a hydraulic coupling, can fairly be used in place of the pneumatic clutch.

At the same time, it is possible to constitute the clutch such that the amount of the slip is increased as the force exerted by the clutch piston 10 increases, or such that the amount of the slip is decreased as the force of the clutch piston 10 increased.

What is claimed is:

1. In a twin-shaft Z-type propelling arrangement for a tug boat or the like including: a main engine, a Z-type propeller means connected to said engine for propelling said tug boat, a variable slip transmission means provided between said main engine and said Z-type propelling means, means for regulating the speed of said engine and means for varying the slip of said variable slip transmission means, the improvement comprising: control means for controlling said engine speed regulating means and said means for varying the slip of said variable slip transmission means to limit the slip of said variable slip transmission means such that slip occurs only during the dead slow speed operation of the main engine.

2. The twin-shaft Z-type propelling arrangement as claimed in claim 1, wherein said transmission means comprises a pressure fluid operated friction clutch including friction clutch discs, and said system further comprises a pressure fluid supply, and said means for varying the slip of said variable slip transmission means comprises means for increasing the fluid supply to said friction clutch to increase the amount of slip between said clutch discs and said clutch further comprises heat radiating fins for radiating the heat generated during the slipping of the clutch discs.

3. The twin-shaft Z-type propelling arrangement as claimed in claim 1, wherein said variable slip transmission means comprises a friction clutch including fluid pressure operated clutch discs, said arrangement further includes a source of fluid pressure supplied to said friction clutch to vary the slip between said clutch discs responsive to the variation in the supply of pressurized fluid thereto, and said means for varying the slip of said variable slip transmission means comprises a slip control valve, a clutch actuating valve and a fluid supply valve, and means for fluid connecting said source of pressurized fluid through said fluid supply valve to said slip control valve and thence to said friction clutch through said clutch actuating valve and said arrangement further comprises a switch for shifting said actuating valve to control the flow of pressurized fluid from said slip control valve to said friction clutch.

4. The twin-shaft Z-type propelling arrangement as claimed in claim 1, wherein said means for regulating engine speed comprises a speed control valve, a speed control piston, and a governor, said source of pressurized fluid is connected to said speed control piston through said speed control valve such that operation of said speed control valve varies the flow of pressurized fluid from said source to said speed control and said governor is acted upon directly by said speed control piston to regulate the speed of said main engine.

5. The twin-shaft Z-type propelling arrangement as claimed in claim 1, further comprising a maneuvering handle, multiple cams operatively coupled to said maneuvering handle and to said means for regulating engine speed and for varying the slip of said variable slip transmission means, respectively such that said handle during one range of movement drives said cams to regulate engine speed and provide a variable amount of slip and during a second range regulates engine speed only.

6. In a twin-shaft Z-type propelling arrangement for a boat including: a main engine, twin-shaft Z-type propelling means, a friction clutch provided between the main engine and the Z-type propelling means and forming a variable slip transmission therebetween, and a maneuvering handle operatively coupled to said engine for controlling engine speed, the improvement wherein:

said arrangement comprises means responsive to maneuvering handle movement during a first range of movement for varying the amount of slip of said friction clutch such that slip occurs only during the dead slow speed operation of the main engine and during a second range of movement for controlling only the engine speed from dead-slow speed to full speed without slip of said friction clutch.

* * * * *